United States Patent [19]

Pistorius et al.

[11] 4,046,652

[45] Sept. 6, 1977

[54] PROCESS FOR PREPARING P-BENZOQUINONE DIKETALS

[75] Inventors: Rudolf Pistorius, Benniehausen; Hans Millauer, Eschborn, both of Germany

[73] Assignee: Hoechst Aktiengesellschaft, Frankfurt am Main, Germany

[21] Appl. No.: 642,397

[22] Filed: Dec. 19, 1975

[30] Foreign Application Priority Data

Dec. 21, 1974 Germany ..... 2460754

[51] Int. Cl.[2] ..... C25B 3/02

[52] U.S. Cl. ..... 204/78; 260/611 R

[58] Field of Search ..... 204/78

[56] References Cited

U.S. PATENT DOCUMENTS

| | | | |
|---|---|---|---|
| 2,285,858 | 6/1942 | Horrobin et al. | 204/78 |
| 3,257,298 | 6/1966 | Hughes | 204/78 |
| 3,592,748 | 7/1971 | Wehrli | 204/78 |
| 3,871,977 | 3/1975 | Scanio | 204/78 |

OTHER PUBLICATIONS

JACS 85 - 2525-2526, Aug. 20, 1963.

*Primary Examiner*—John H. Mack
*Assistant Examiner*—H. A. Feeley
*Attorney, Agent, or Firm*—Curtis, Morris & Safford

[57] ABSTRACT p-Benzoquinone diketals of the formula wherein R is H, an alkyl group having from 1 to 4 carbon atoms or a halogen atom, preferably H, $CH_3$, Cl or F, are prepared by anodic oxidation of benzene or alkoxybenzenes of the formula wherein R has the aforesaid meaning and $R^1$ is an alkyl radical having of from 1 to 4 carbon atoms in $CH_3OH$ containing a. less than about 5% by weight of $H_2O$ as well as
b. about 0.2 to 15% by weight, calculated on the electrolyte, of at least a conducting salt selected from the group of ammonium and alkali fluorides, perchlorates, nitrates, tetrafluoroborates, hexafluorosilicates, hexafluorophosphates, benzene sulfonates, p-toluene sulfonates, quartenary ammonium and phosphonium fluorides as well as methylsulfates and additionally
c. optionally about 0.5 to 10% by weight, calculated on the electrolyte, of a base to be oxidized with difficulty, preferably 2,6-lutidine, at a known anode made of a conventinal material, at a temperature of from about −20° to +60° C. When using as starting material an alkoxybenzene wherein the group $OR^1$ contains an alkyl radical having of from 2 to 4 carbon atoms, the resultant p-benzoquinone tetramethyl diketal contains a small quantity of the corresponding trimethyl alkyl diketal having an alkyl group of from 2 to 4 carbon atoms in the alkoxy group. The diketals obtained may be converted into the corresponding p-quinones by acidic hydrolysis and are, consequently, valuable intermediates for the preparation of the latter as well as for the transformation into the corresponding hydroquinones, which in their turn may be used in known manner in photography, as stabilizers for monomers, as starting material for dyestuff preparation etc.

12 Claims, 1 Drawing Figure

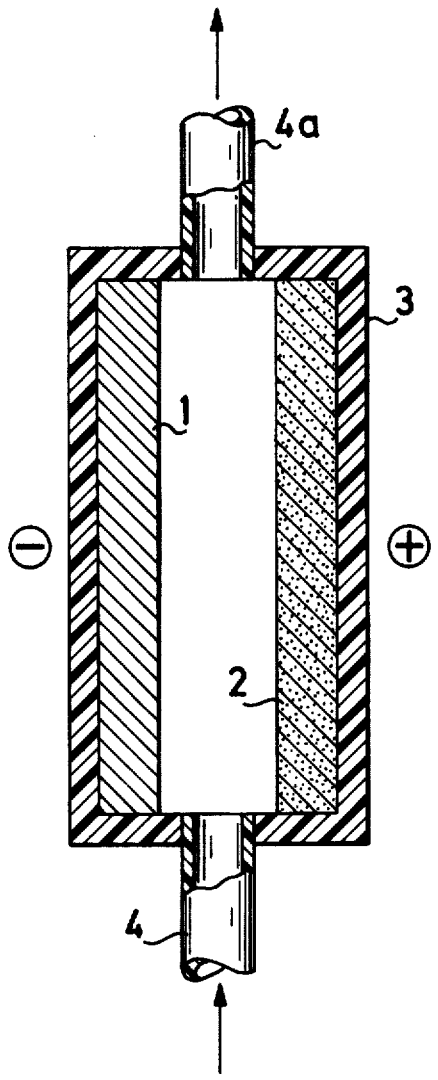
4a
3
1
2
4

PROCESS FOR PREPARING P-BENZOQUINONE DIKETALS p-Benzoquinone diketals are valuable intermediates, as they may be readily hydrolyzed to give the corresponding quinones. When using as starting compound, for example, the tetramethyl ketal of the unsubstituted p-benzoquinone in an aqueous acidic medium, the p-benzoquinone is obtained according to the following equation:

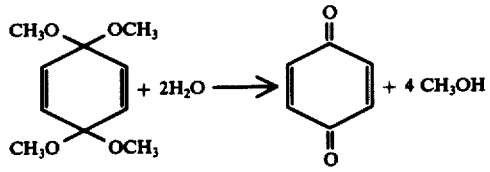

It is known to prepare these quinone diketals in electrochemical manner by anodic oxidation of benzenic starting compounds in methanol/KOH (cf.N. L. Weinberg and B. Balleau. J.AM. Chem.Soc. 85 (1963), 2525–26; Tetrahydron Letters 29 (1973), 279–85). In the cited references anisol as well as methyl ethers of multivalent phenols having, however, besides the methoxy groups, no further substituents, are used as starting compounds. The formation of diketals obviously is impeded by the presence of further substituents, for example, the nitrile and the methoxy carbonyl group. In particular, the unsubstituted benzene, may not be reacted.

This reaction has not really acquired technical importance as the required starting compounds, for example, the hydroquinone dimethyl ether, are generally prepared from p-benzoquinone, the compound for which a synthesis simpler than those hitherto known is to be found. If the p-benzoquinone diketals could be obtained in an easy manner without using the basic quinone, it would be possible in this way to prepare p-benzoquinone in an advantageous manner and moreover optionally the corresponding substituted derivatives.

It was, consequently, an aim of the present invention to develop a more advantageous process as compared to the cited ones for preparing p-benzoquinone diketals, without starting from the basic quinones. It was especially desired to modify optionally the eletrochemical reaction described by Weinberg and Bellau in the aforesaid reference in such a manner that the unsubstituted benzene may be used suitably as starting material. This problem has been solved according to the invention in electrochemical manner in the first place by performing the anodic oxidation of benzene or a corresponding substituted derivative in a methanolic solution containing certain conducting salts.

The present invention, consequently, provides a process for preparing p-benzoquinone ketals in an electrochemical procedure by anodic oxidation of benzenic starting compounds in methanolic solution containing also compounds improving the conductivity of the solution, which comprises oxidizing anodically benzene or an alkoxybenzene of the formula

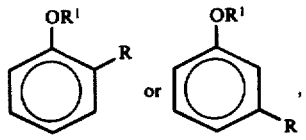

whereing R represents hydrogen, an alkoxy group having especially from 1 to 4 carbon atoms or halogen and $R^1$ represents an alkyl group having especially from 1 to 4 carbon atoms, in methanol, containing as conducting medium less than about 5% by weight of water as well as about 0.2 to 15% by weight, calculated on the electrolyte, of at least an ammonium or alkali fluoride, perchlorate, nitrate, tetrafluoroborate, hexafluorosilicate, hexafluorophosphate, benzene sulfonate or p-toluene sulfonate and/or at least a quaternary ammonium and/or phosphonium salt of the formula $A_xB_{4-x}Z^+Y^{31}$ wherein A represents identical or different alkyl radicals, B represents the group $C_6H_5$,
x represents an integer of from 1 to 4,
Z represents N or P and
Y represents F or $SO_4CH_3$, and optionally about 0.5 to 10% by weight, calculated on the electrolyte, of a base that oxidizes with difficulty, at a pH of more than 7, preferably up to about 14 and especially up to about 13, at a known anode made of graphite, a metal of the platinum group, its alloys or of $PbO_2$, at a temperature of from about −20° to +60° C to obtain p-benzoquinone tetramethyl ketal of the formula

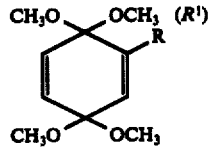

wherein R represents hydrogen, an alkyl group having especially of from 1 to 4 carbon atoms or halogen. R preferably represents H,$CH_3$,Cl or F and possibly Br. ($R^1$) in the formula of the benzoquinone diketal signifies that, if alkoxy benzenes of the formula

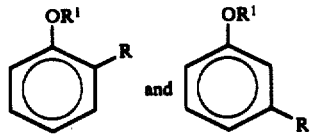

wherein $R^1$ represents an alkyl group having of from 2 to 4 carbon atoms, are used as starting material in the anodic oxidation, an $OCH_3$ group in the p-benzoquinone diketal formed is replaced in subordinate manner by the $OR^1$ group containing the higher alkyl radical and having of from 2 to 4 carbon atoms. An exchange of the $OR^1$ group (wherein $R^1$ represents an alkyl having of from 2 to 4 carbon atoms) for the $OCH_3$ group obviously takes place during the electrolytic reaction performed in $CH_3OH$. An insufficient quantity of trimethyl alkyl ketal in the tetramethyl ketal does not disturb the working up of the diketal to obtain p-benzoquinone, as in either case the quinone is formed in the same manner.

The preferred temperature for the anodic oxidation is in the range of from about 0° to +40° C, especially from +20° to +35° C. The eletrolyte in the process of the invention comprises the methanolic solution containing a conducting salt and, optionally, water and a base that oxidizes with difficulty, but not the substance to be oxidized. In special cases the electrolyte may contain small quantities of a Co-solvent such for example, as dioxan, for improving the solubility.

The p-benzoquinone tetramethyl ketal may be obtained according this process in good or very good yields, by using benzene as starting material. The same final product may also be obtained by starting from anisol, although the use of the unsubstituted anisol as starting material is less favorable. The same ketal may also be formed by starting from unsubstituted alkoxy benzenes wherein the alkoxy groups contain alkyl radicals having of from 2 to 4 carbon atoms. But in this case the tetramethyl ketal is partially mixed with the corresponding trimethyl alkyl ketal. Alkoxy benzene substituted in o- or m-position by an alkyl group having preferably of from 1 to 4 carbon atoms or halogen furnishes the corresponding substituted p-benzoquinone tetramethyl ketal (containing small quantities of trimethylketal). In this process a further $OCH_3$ group is added to the C atom of the alkoxy benzene where the $R^1$ group is placed with a partial exchange of the $OR^1$ group by the $OCH_3$ group and the other ketal grouping takes place at the carbon atom of the aromatic nuleus being in p-terminal position with regard to said $OCH_3$ group. The substituents remain unchanged during this reaction. In this way, for example, the monochloro-p-benzoquinone tetramethyl ketal (and a small quantity of trimethyl ketal) may be obtained from o-Clalkoxy benzene, the monofluoro-p-benzoquinone tetramethyl ketal (and small quantities of trimethyl alkyl ketal) from m-F-alkoxybenzene and the monoethyl-p-benzoquinone tetramethyl ketal (and small amounts of trimethyl alkyl ketal) from o-ethyl alkoxybenzene etc. It is extremely surprising with regard to the reaction of Weinberg and Belleau, wherein anisol hardly reacts and the benzene does not react at all that said reaction is successful, especially when using benzene as starting material.

The eletrochemical reaction according to the invention may be performed in an undivided cell or in a cell divided into a cathode and an anode space by any of the conventional diaphragms. The diaphragms may be made of the usual porous materials or of ion selective membranes. The construction of the electrolysis cells is not critical; the reaction according to the invention may be carried out in a simple cell as indicated in Example 1. The cathode material is also non-critical. Copper, nickel, steel, platinum graphite etc. may be used therefor, especially steel and graphite.

Graphite, the metals of the platinum group (Ru, Rh, Pd, Os, Ir and Pt) or their alloys or $PbO_2$ may be used as anode material. Graphite and platinum are preferably used.

The construction of the electrodes, i.e. of the cathode as well as of the anode, is not critical. The process may be carried out using simple rods, plates, metal sheets, nets or agglomerations of spherules. Electrodes stable towards fluoride ions and having a smooth surface are preferably used. When using $PbO_2$, coatings on a conducting support, especially graphite or titanum are suitable.

The electrolyte, which should have the same composition in the anode and cathode space, even in cells divided by permeable diaphragms, consists of methanol containing up to about 5% by weight, preferably not more than about 2% by weight of water. Technically pure methanol is preferably used. An important and critical factor for the process of the invention is the choice of the conducting salts, i.e., the compounds enabling the transport of current. The ammonium and alkali salts (Li,Na,K,Cs,Rb) of hydrofluoric acid, perchloric acid, nitric acid, tetrafluoroboric acid, hexafluorosilicic acid and hexafluorophosphoric acid as well as of benzene sulfonic acid and p-toluene sulfonic acid have proved especially advantageous.

Quartenary ammonium and phosphonium salts of the formula $A_xB_{4-x}Z^+Y^-$ wherein A represents identical of different alkyl radicals having preferably of from 1 to 4 carbon atoms, B represents $C_6H_5$, x represents an integer of from 1 to 4, Z represents N or P and Y represents F or $SO_4CH_3$, are likewise suitable.

There may be mentioned, by way of example: $(CH_3)_4NF$, $(CH_3)_2(C_6H_5)_2NF$, $(CH_3)_4PF$, $(C_2H_5)_3C_6H_5PF$, $(C_2H_5)_4PSO_4CH_3$, $(CH_3)_2(n\text{-}C_4H_9)_2PSO_4CH_3$ etc.

The conducting salts are prepared in known manner, provided that there are not used commercial products.

The quartenary ammonium and phosphonium fluorides may be advantageously prepared from the corresponding chlorides in known manner by a double reaction in methanol with KF, by using preferably a molar excess of KF of from about 0.5 to 1. The excess of KF and the major part of the potassium chloride may be filtered off after concentration, as the quaternary fluorides are readily soluble in methanol, KF and KC1 being less soluble. For this purpose the solutions of conducting salts are concentrated to such an extent that about 5 moles of quaternary fluoride are dissolved in 1.5 liter of methanol, the residual content of chloride (of from 0.5 to 5% by mole) does not disturb the electrolysis.

The fluorides $A_xB_{4-x}Z^+Y^-$ may also be prepared by electrolysis from the corresponding chlorides in divided cells provided with cation exchanger membranes by placing the chloride dissolved in methanol in the anode space. During electrolysis the ammonium or phosphonium ion migrates into the cathode space where it may be withdrawn in the form of $A_xB_{4-x}Z^+CH_3^-$, dissolved in methanol. Suitable conducting salts are also obtained when neutralizing subsequently with HF, adjusted to a pH of 8 to 10.

The quarternary ammonium and phosphonium sulfates may be prepared, for example, in simple manner, from the corresponding tertiary amines or phosphines dissolved in methanol, by slowly adding dimethyl sulfate, until the solution shows a neutral reaction and amines or phosphines cannot be detected any longer. Especially suitable conducting salts are $NaClO_4$, KF, $(CH_3)_4NF$, $(CH_3)_4PF$, $(CH_3)_4NSO_4CH_3$ and $(CH_3)_4PSO_4CH_3$. One salt may be used as well as a mixture of two or more salts. The quantity of the conducting salts used depends on their solubility in methanol, which varies for the cited salts; it may be in the range of from about 0.2 to 15% by weight, preferably of from about 1 to 5% by weight, calculated on the electrolyte. If only quaternary ammonium and phosphonium salts are used, quantities of up to about 30% by weight, calculated on the electrolyte, may be used because of their good solubility in methanol.

In the course of the tests it has become evident that a solution of KF in methanol of from about 0.2 to 10, preferably of from about 1 to 5% by weight, having a water content of not more than about 5% by weight not only constitutes an excellent electrolyte for the process according to the invention, but in general for organic electrolytic oxidations, for example, even for the anodic methoxylation of cyclohexene, which is known to be difficultly oxidizable. (cf.J.Am.Chem.Soc. 94 1972, page 7092) etc.

It has moreover proved advantageous for the process of the invention to add to the electrolyte an organic base which cannot be oxidized even under the electrolysis conditions. There may be mentioned, by way of example, 2,6-lutidine. The quantity of the base should be from about 0.5 to 10, preferably, from about 2 to 5 % by weight, calculated on the electrolyte. The base guarantees that the pH does not drop below 7 in the electrolyte solution; the p-benzoquinone ketals would rapidly decompose if the reaction were more acidic.

Because of the sensitivity of the quinone ketals in an acidic medium, care must be taken that the pH of the electrolyte is always at least 7, measured with wet pH paper. The pH is advantageously in the range of from about 7 to about 14, preferably of from about 7 to about 13. For determining the pH one may also operate in the following manner: One part by volume of the electrolyte is mixed with one part by volume of water and the pH of this mixture is determined in known manner, for example by means of a glass electrode and one of the conventional types of apparatus for measuring the pH. The desired pH of the electroylte may optionally be reached by adding a basic compound, preferably an alkali or a tetraalkyl ammonium methylate or hydroxide such, for example, as $N(CH_3)_4OCH_3$ or NaOH.

In some cases, especially when using the quaternary ammonium and phosphonium salts as conducting salts, the desired pH range may frequently be reached after a short electrolysis starting period, probably due to small quantities of alkali which may be included in said compounds.

If the pH value should increase during electrolysis to an undesirably high extent, it may be adjusted advantageously by adding small quantities of HF, preferably methanolic HF.

The current quantity applied should be at least equivalent to the quantity of the starting material to be oxidized, i.e. when using benzene, corresponding to a 6 electrodes reaction, 6 faraday/mole (about 161 Ah), and when using anisol 4 faraday/mole.

Generally a greater excess for example, of up to about 4 times, perferably from about 1.5 times to 3 times the theoretically required current quantity, however, is used.

The chosen current density per $dm^2$ of the anode surface may be in the usual range of from about 0.5 to about 40 $A/dm^2$, preferably from about 5 to 20 $A/dm^2$. The cell voltage results from the current intensity, the conductivity and the dimensions of the cell; it is generally from about 4 to 30 volts.

The process according to the invention may be carried out batchwise, semi-continuously or fully continuously. In the first case the whole quantity of benzene or of the corresponding alkoxy-benzene is introduced, quantities greater than those capable of being dissolved in the electrolyte being likewise possibly used. In the semi-continuous method the same amount is added gradually, in the same measure as it is consumed during electrolysis. The total of the quantities used are in the range of from approximately 1 to 50 parts by weight, preferably from about 5 to 23 parts by weight per 100 parts by weight of the electrolyte. The continuous process is performed by connecting several electrolysis cells in cascade form. For improving the current efficiency the charge preferably is not completely electrolyzed, but electrolysis is stopped when a conversion of about 90%, preferably, of about 80% is reached.

The reaction mixture is worked up in usual manner, for example, by distilling off the methanol and the starting material which has not reacted and by subsquently distilling the crude product under an adequately reduced pressure or by extraction and/or crystallization of the products of the process of the invention.

When using quaternary ammonium or phosphonium compounds as conducting salts, the working up is performed according to the following method: The reaction mixture is extracted, preferably after concentration, which may also be performed in vacuo, with approximately 3 to 5 times the quantity by volume of a suitable solvent, for example, petroleum ether, for example, in a pulsation column, distilled off after having separated the extracting agent and the residue is distilled by fractionation. The diketal crystallizes from the distillate and may be further purified by recrystallization, for example, from hexane and cyclohexane.

The products of the process of the invention may be converted into the corresponding p-quinones in known manner by acidic hydrolysis and are, consequently, valuable intermediates for the preparation of the latter as well as for the transformation into the corresponding hydroquinones, which may be used in known manner in photography as stabilizers for monomers, as starting compounds for the dyestuff preparation etc. Especially important intermediates are p-benzoquinone diketals of the formula

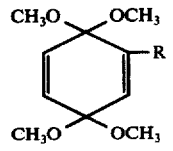

wherein R is an alkyl group having of from 1 to 4 carbon atoms, Cl or F. There may be mentioned particularly the methyl and the Cl-p-benzoquinone tetramethyl diketal (wherein R is $Ch_3$ or Cl). These compounds are also novel.

When using methyl-p-benzoquinone tetramethyl diketal as a starting material, the leather dyestuff "acid leather-brown EGB" (cf. Ullmann's Enzyklopadie der technischen Chemie, 3rd edition, volume 4 (1953),268), may be obtained, for example, via the corresponding methyl-p-benzoquinone. The chloro-p-benzoquinone tetramethyl diketal, may be hydrogenized catalytically, for example, in propionic acid, while using a noble metal catalyst such, for example, as Pd or Pt to obtain the chloro-hydroquinone dimethyl ether, which in its turn may be converted into 2-Cl-5-amino-hydroquinone ether by nitration and selective reduction of the nitro group; said ether is a component for naphthol AS dyestuffs such, for example, as Naphthol AS-LC® or Naphthol AS-L3G® (cf. Ullmann's Enzyklopadie der technischen Chemie, 3rd edition, volume 4 (1953) 136).

The following examples illustrate the invention

EXAMPLE 1

In a double-walled cell cooled with water, having a volume of about 750 ml. 20 g of benzene dissolved in an electrolyte consisting of 650 ml of methanol and 7.5 g of KF were electrolyzed at a cyclindrical platinum wire-gauze electrode ($\phi$ 4cm, height 4 cm) as anode and a tube of Cr-Ni steel (V4A) of a diameter of 12 mm as cathode which was separated from the anode by a porous polyethylene tissue, with a current intensity of about 3.5 amperes and a voltage of about 22 volts at a temperature of 22° C until 18.5 Ah had passed. Stirring was effected by means of a magnetic rod agitator fixed at the bottom of the cell.

Methanol as well as benzene were used in a technically pure quality. For working up, methanol and benzene were distilled off and 8 g of benzoquinone tetramethyl ketal (having a melting point of 43° C) were distilled from the crude product obtained (16 g) at a temperature of from 86° to 89° C and under a pressure of 0.3 mm Hg, which corresponded to a yield of substance of 83% of the theory.

The iodometrical determination according to the reaction equation

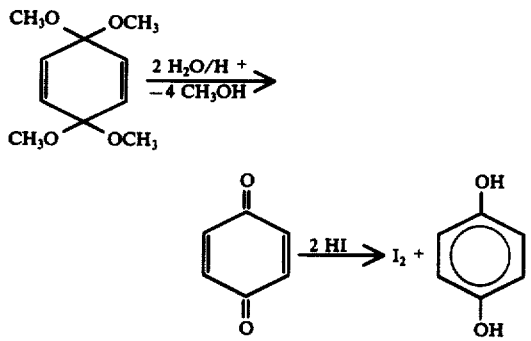

revealed a current efficiency of 36.8%, which corresponded to a yield of substance of 86% of the theory.

EXAMPLE 2

Under the same conditions as in Example 1 20g of benzene were electrolyzed at two graphite plates (Diabon®) of 4 × 10 × 0.5 cm fixed at a distance of 0.8 cm from each other with a current intensity of 2.2 amperes until 18.5 Ah had been delivered. The iodometrical determination revealed a current efficiency of 31.5% for p-benzoquinone tetramethyl ketal.

EXAMPLE 3

Under the same conditions as in example 1 35 g of chloroanisol were electroylzed until 11 Ah had passed. The iodometrical titration indicated a current efficiency of 37% for chloro-p-benzoquinone tetramethyl ketal.

EXAMPLE 4

In a circulation cell 3 (cf. drawing) being provided with a cathode of Cr-Ni-steel (V2A) having a surface of 200 cm² and a graphite anode (Diabon®) 2 having a surface of 218 cm² and an inlet 4 and an outlet 4a for the electrolyte 200 g of o-chloroanisol dissolved in an electrolyte which consisted of 5 liters of methanol and 77 g of KF were electrolyzed at a temperature of 30° C with a current intensity of 20 A and a voltage of from 6 to 8 volts until a current passage of 154 Ah had occured. According to a iodometrical determination on a current efficiency of 50% was obtained. Distillation of the reaction mixture yielded besides methanol 52 g of unconsumed chloranisol, 135 g of chloro-p-benzoquinone tetramethyl ketal and 26 g of distillation residue, corresponding to a yield of chloro-p-benzoquinone tetramethyl ketal of 60 % of the theory

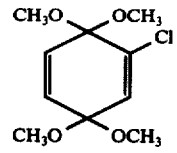

melting point: 64° C

NMR: $\tau$ = 3.6 - 4.2 (3H,m); $\tau$ = 6.65, 6.68 (12H,2 s)

$C_{10}H_{15}O_4Cl$ MG calculated: 15.11% of chlorine; 51.16% of C; 6.45% of H; found : 15.2% of chlorine; 51.1 % of C; 6.3% of H

EXAMPLE 5

Under the same conditions as in Example 4 a graphite plate (Diabon ®) coated with $PbO_2$ was used instead of the graphite plate of the aforesaid examples. The current efficiency was likewise 50%.

EXAMPLE 6

35 g of m-cresolmethyl ether were electrolyzed under the conditions of Example 1 until a passage of 22.8 Ah had occurred. The iodometrical determination revealed a current efficiency of 30.7%. 7.8 g of compound of the following formula

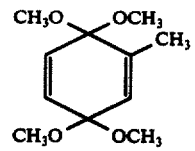

were obtained in a distillation at a temperature of 86° C under a pressure of 0.6 torr besides the starting material which had not been consumed, which was in a liquid state at room temperature and crystallized when placed in a refrigerator (melting point of 6° C).

NMR: $\tau$ = 3.6 - 4.2 (3H,m), $\tau$ = 6.66; 6.82 (12H, 2 s); $\tau$ = 8.23 (3H,d)

calculated: 61.66% of C; 8.47% of H found: 61.6% of C; 8.4% of H

EXAMPLE 7

In a cell as used in Example 1 having a volume of 250 cm² 10.8 g of anisol in an electrolyte consisting of 200 ml of methanol and 6 g of KF were electrolyzed at a platinum plate as anode and a platinum cathode of the same size at a temperature of 25° C until a current passage of 16.33 Ah was reached. According to a iodometrical determination a current efficiency of 33 % for p-benzoquinone tetramethyl ketal was obtained.

EXAMPLE 8

Under the same conditions as in Example 1 35 g of benzene with 15 g of $NaClO_4$ as conducting salt were electrolyzed while adding 10 ml of 2,6-dimethyl pyridine until a current passage of 18.5 Ah was reached. The iodometrical determination indicated a current efficiency of 22%.

EXAMPLE 9

The test arrangement was the same as in Example 4. 300 g of o-chloroanisol and 100 g of KF were used. Electrolysis was performed at a voltage of 5.6 volts until a current passage of 131.4 Ah. The iodometrically determined current efficiency was 63%.

EXAMPLE 10

Under the conditions of Example 1 20 g of benzene were electrolyzed with 15 g of $NaBF_4$ as conducting salt with the addition of 20 ml of 2,6-dimethyl pyridine until 18.5 Ah had passed. The iodometrically determined current efficiency was 13.7%.

EXAMPLE 11

In a circuation cell having a Cr-Ni-steel (V2A) cathode of a surface of 200 $cm^2$ and a graphite anode (glassy carbon anode) of a surface of 220 $cm^2$ 340 g of benzene dissolved in an electrolyte consisting of 0.6 mole of $N(CH_3)_4F$ and methanol (total volume 3 liters) were electrolyzed at a temperature of about 35° C, with a current intensity of 30 amperes and a volgage of from 5.5 to 7.3 volts until 325 Ah of current had been consumed. According to the iodometrical titration a current efficiency for p-benzoquinone tetramethyl ketal of 38% was reached, while the yield of substance was 70%. The pH during electrolysis was about 8.5.

EXAMPLE 12

In an analogous manner to Example 11 380 g of o-chloroanisol were electrolyzed with a current intensity of 35 amperes until 320 Ah had been consumed. The iodometrically determined current efficiency was about 54% for a pH of the electrolyte during electrolysis of 9.5.

EXAMPLE 13

In a double-walled cell cooled with water of the nature described in Example 1 35 g of benzene dissolved in an electrolyte consisting of 620 ml of methanol, 0.15 mole of $(CH_3)_4$-P+F− were electrolyzed with a current intensity of 3.5 amperes and a voltage of about 13 volts at a temperature of 25° C until 18.5 Ah had passed. The pH during electrolysis was about 8.5. The iodometrical titration indicated a current efficiency of 48%, the yield of substance being 80%. Stirring was performed by means of a magnetic rod.

EXAMPLE 14

In a double-walled cell cooled with water of the nature described in Example 1 35 g of benzene dissolved in an electrolyte consisting of 620 ml of methanol and 0.15 mole of $(CH_3)_4$—O—$(SO_2)$—$OCH_3$ were electrolyzed with a current intensity of 3.5 amperes and a voltage of 13 volts at a temperature of 25° C until 18.5 Ah had passed. The pH was adjusted to a value of 9.9 by adding $N(CH_3)_4$—$OCH_3$. The current efficiency for p-benzoquinone tetramethyl ketal determined iodometrically was 31%. Stirring was performed by means of a magnetic rod.

EXAMPLE 15

In a double-walled cell cooled with water of the nature described in Example 1 35 g of benzene dissolved in an electrolyte consisting of 620 ml of methanol and 0.15 mole of $P(CH_3)_4F$ were electrolyzed with a current intensity of 3.5 amperes and a voltage of 13 volts at a temperature of 25° C until 18.5 Ah had passed. The pH of the electrolyte was 12.1 after a short time of electrolysis. The current efficiency for p-benzoquinone tetramethyl ketal was 50%, the yield of substance being 75%.

EXAMPLE 16

Under the same conditions as in Example 15 35 g of m-cresyl ether were electrolyzed until 15 amperes had passed. 0.13 mole of $N(CH_3)_4F$ were used as conducting salt. The pH was about 11.5 after an electrolysis time of 5 minutes and was in the range of from 11.5 to 12.6 during the rest of the time. The iodemetrical titration showed a current efficiency for methyl-p-benzoquinone tetramethyl ketal of 51.6% for a yield of substance of 75%.

EXAMPLE 17

Under the same conditions as in Example 15 35g of benzene were electrolyzed until 15 Ah had passed. $N(CH_3)_4F$ was used as conducting salt. The pH values corresponded to those of Example 2. The iodometrically determined current efficiency was 53%, the yield of substance being 83%.

EXAMPLE 18

In a circulation cell of the nature described in Example 4 340 g of benzene dissolved in an electrolyte consisting of 0.6 mole of N $(CH_3)_4F$ and methanol (total volume of gas 3 liters) were electrolyzed at a temperature of from 30° to 40° C with a current intensity of 30 amperes and a voltage of from 5.5 to 7.3 volts until 325 Ah had been consumed. According to the iodometrical titration a current efficiency of 40% was obtained and a yield of benzoquinone tetramethyl ketal of about 75%. The initial pH value of 8 of the electrolyte increased to 12.5 after a short time of electrolysis (20 minutes).

EXAMPLE 19

In a circulation cell of the nature described in Example 4, 4.8 kg of o-chloroanisol in an electrolyte consisting of 32.8 liters of MeOH and 880 g of $N(CH_3)_4F$ were electrolyzed with a current intensity of 30 amperes until a current passage of 4176 Ah had occurred, at a temperature of from 25° to 34° C, the pH being 12.5. The voltage was in the range of from 6 to 6.5 volts. 4.99 kg of chloro-p-benzoquinone tetramethyl ketal were obtained corresponding to a current efficiency of 54 %.

EXAMPLE 20

In a double-walled cell cooled with water as described in Example 1 35 g of anisol dissolved in an electrolyte consisting of 650 ml of methanol, 0.13 mole of $(CH_3)_4P$+F− (residual content of Cl−: 3 % by mole) were electrolyzed with a current intensity of 3.5 amperes and a voltage of about 16 volts at 22° C until a current passage of 18.5 Ah had occurred. Stirring was effected by means of a magnetic rod stirrer fixed at the bottom of the receptacle. The pH of the electrolyte after an electrolysis time of 5 minutes was about 12.

The iodometrical determination according to the reaction equations:

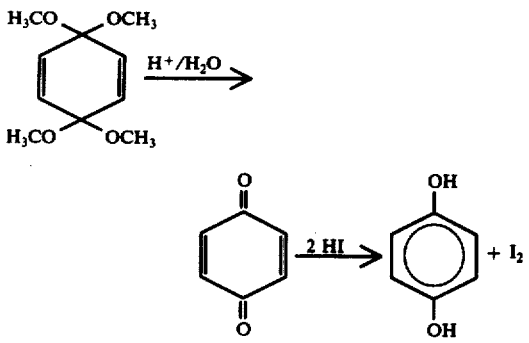

showed a yield of substance of about 85% and a current efficiency of 55%.

EXAMPLE 21

In a cell as in Example 1 30 g of phenetole in an electrolyte consisting of 0.1 mole of $N(CH_3)_4F$ and 250 ml of methanol were electrolyzed until a current consumption of 17.7 Ah had been reacted. The pH during electrolysis was 12.3. The solvent ($CH_3OH$) was distilled off, the product was given into 180 ml of water and extracted four times with ether. 30 g of crude product consisting of 60% of p-benzoquinone tetramethyl ketal besides 40% of p-benzoquinone trimethyl ethyl ketal according to an analysis by gaschromatogrphy were obtained by distillation at 0.5 torr and a temperature of from 40° to 85° C.

EXAMPLE 22

In an undivided circulation cell as described in Example 4 27 g of anisol in an electrolyte consting of 93 g of tetramethyl ammonium fluoride prepared by reacting tetramethyl ammonium chloride with potassium fluoride in methanol, and 2300 g of methanol were electrolyzed at a temperature of from 26° to 30° C with a current intensity of 60 amperes and a voltage of from 6.5 to 7.5 volts until a current passage of 420 Ah had occurred. During electrolysis (until a current passage of about 300 Ah had been attained) 297 g of anisol were added dropwise at a rate of about 1 ml/Ah. The total quantity of anisol used was, consequently, about 324 g (3.0 moles). The pH of the electrolyte adjusted itself to a value of from 12.2 to 12.5 after a short time of electrolysis. The test arrangement was completed by a degasifying receptacle, whereto the electrolyte was led after having passed the circulation cell to give off the cathodiocally formed hydrogen, by a heat exchanger and a glass centifugal pump repumping the electrolyte to the circulation cell. The quantity of p-benzoquinone tetramethyl ketal in the electrolyte determined iodometrically was 204 mole, which corresponded to a current efficiency of 52%.

The electrolyte was concentrated in a rotative evaporator at a temperature of 50° C and under a pressure of about 20 torrs, the residue was extracted four times with hexane, the hexane phase was concentrated and decomposed by fractional distillation. The fraction distilling at a temperature of from 85 to 90° C under a pressure of 0.2 bar (405 g) consisted of about 90% of p-benzoquinone tetramethyl ketal according to the analysis by gaschromatography.

This corresponded to a yield of about 60% calculated on anisol used.

EXAMPLE 23

In a test arrangement as described in Example 4, 270 g of anisol in an electrolyte consisting of 35 g of potassium fluoride and 2400 g of methanol, were electrolyzed at a temperature of from 25° to 27° C with a current intensity of 30 amperes and a voltage of from 5 to 6 volts until a current passage of 250 Ah had occurred.

By adding 2.1 g of potassium methylate at the beginning of the electrolysis a pH of about 11.7 was established, which increased to about 12.5 during electrolysis.

The quantity of p-benzoquinone tetramethyl ketal in the electrolyte determined iodometrically was 0.88 mole, which corresponded to a yield of 65%.

EXAMPLE 24

In the same cell as in Example 1 35 g of benzene, dissolved in an electrolyte consisting of 620 ml of methanol, 0.08 mole of $P(CH_3)_4F$ and 0.08 mole of $N(CH_3)_4F$ were electrolyzed with a current intensity of 3.5 amperes and a voltage of 13 volts at a temperature of 25° C until a current passage of 18.5 Ah had occurred. The electrolyte was adjusted to a value of 9.8 during electrolysis by adding small quantities of HF. The current efficiency for p-benzoquinone tetramethyl ketal was 50% and the yield about 75%.

EXAMPLE 25

In the same cell as in Example 1 35 g of benzene dissolved in an electrolyte consisting of 620 ml of methanol and 0.2 mole of $NCH_3(C_2H_5)_3F$ were electrolyzed with a current efficiency of 4.0 amperes and a voltage of 11 volts at a temperature of 25° C until a current passage of 18.5 Ah had occurred. The electrolyte was adjusted to a pH of 9.8 during electrolysis by adding small quantities of HF, dissolved in methanol. The conducting salt $NCH_3(C_2H_5)_3F$ still contained 5% by mole of chloride. The iodometrically determined current efficiency was about 26%, the yield being 60%.

What is claimed is:

1. A process for electrochemically preparing p-benzoquinone ketals which comprises anodically oxidizing benzene per se or an alkoxybenzene of the formula

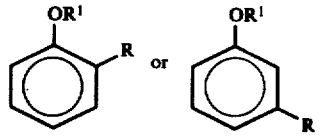

wherein R is hydrogen, an alkyl group having from 1 to 4 carbon atoms or halogen and $R^1$ is an alkyl group having from 1 to 4 carbon atoms, in an electrolyte which is a methanolic solution containing no more than about 5% by weight of water and about 0.2 to 15% by weight, calculated on the electrolyte, of a conductivity improving salt selected from ammonium and alkali metal fluorides, perchlorates, nitrates, tetrafluoroborates, hexafluorosilicates, hexafluorophosphates, benzene sulfonates, p-toluene sulfonates and quaternary ammonium and phosphonium salts of the formula $$A_xB_{4-x}Z^+Y^-$$

wherein A represents identical or different alkyl radicals,

B represents $C_6H_5$, $x$ represents an integer of from 1 to 4,

Z represents N or P and

Y represents F or $SO_4CH_3$ as well as mixtures of such salts at a pH of more than 7, at an anode of a material selected from graphite, metals of the platinum group, alloys thereof and $PbO_2$, at a temperature of from about −20° to +60° C, to obtain a p-benzoquinone tetramethyl ketal of the formula

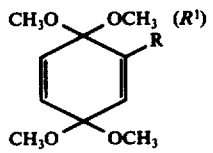

wherein R and $R^1$ have the meaning given above.

2. A process as claimed in claim 1 wherein R represents only alkyl groups having from 1 to 4 carbon atoms, if $R^1$ is $CH_3$.

3. A process as claimed in claim 1 is selected from H, $CH_3$, Cl and F.

4. A process as claimed in claim 1 wherein the conductivity improving salt is selected from $NaClO_4$, KF, $(CH_3)_4NF$, $(CH_3)_4NSO_4CH_3$ and $(CH_3)_4PSO_4CH_3$.

5. A process as claimed in claim 1 wherein the anodic oxidation is carried out at a pH of 7 to about 14.

6. A process as claimed in claim 1 which comprises carrying out the anodic oxidation at a temperature of from about 0° to +40° C.

7. A process as claimed in claim 1 which comprises carrying out the anodic oxidation at a temperature of from about +20° to +35° C.

8. An electrolyte adapted to be used in carrying out organic-electrochemical oxidation, said electrolyte consisting essentially of a 0.2 to 10% by weight solution of KF in methanol having a water content of no more than about 5% by weight.

9. A process according to claim 1 wherein the electrolyte contains from 0.5 to 10% by weight of a difficultly oxidizable base to increase the pH thereof.

10. A process as claimed in claim 9 wherein the difficulty oxidizable base is 2,6-lutidine.

11. A process for electrochemically preparing p-benzoquinone ketals which comprises anodically oxidizing benzene per se or an alkoxybenzene of the formula

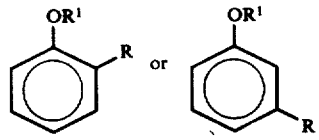

wherein R is hydrogen, an alkyl group having from 1 to 4 carbon atoms or halogen and $R^1$ is an alkyl group having from 1 to 4 carbon atoms, in an electrolyte which is a methanolic solution containing no more than about 5% by weight of water and about 0.2 to 15% by weight, calculated on the electrolyte, of a conductivity-improving salt selected from ammonium and alkali metal fluorides, perchlorates, nitrates, tetrafluoroborates, hexafluorosilicates, hexafluorophosphates, benzene sulfonates, p-toluene sulfonates and quaternary ammonium and phosphinium salts of the formula $$A_xB_{4-x}Z^+Y^-$$

wherein A represents identical or different alkyl radicals,

B represents $C_6H_5$, $x$ represents an integer of from 1 to 4.

Z represents N or P and

Y represents F or $SO_4CH_3$ as well as mixtures of such salts at a pH of more than 7, at a temperature of from about −20° to +60° C., to obtain a p-benzoquinone tetramethyl ketal of the formula

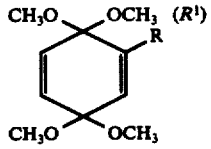

wherein R and $R^1$ have the meaning given above.

12. A process according to claim 11 wherein the electrolyte contains from 0.5 to 10% by weight of a difficultly oxidizable base to increase the pH of the electrolyte.

* * * * *